US008894167B2

(12) United States Patent
Lee et al.

(10) Patent No.: US 8,894,167 B2
(45) Date of Patent: Nov. 25, 2014

(54) REFRIGERATOR

(71) Applicant: LG Electronics Inc., Seoul (KR)

(72) Inventors: Daesung Lee, Changwon-si (KR); Seonkyu Kim, Changwon-si (KR); Woonkyu Seo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/049,594

(22) Filed: Oct. 9, 2013

(65) Prior Publication Data

US 2014/0117830 A1 May 1, 2014

(30) Foreign Application Priority Data

Oct. 30, 2012 (KR) ..... 10-2012-0121644

(51) Int. Cl.
*A47B 96/04* (2006.01)
*F25D 25/02* (2006.01)

(52) U.S. Cl.
CPC ..... *F25D 25/025* (2013.01)
USPC ..... 312/402

(58) Field of Classification Search
CPC .... F25D 23/021; F25D 23/025; F25D 23/062
USPC ..... 312/401, 402, 404, 405, 334.6, 348.3; 62/440, 441, 457.1, 457.7; 206/549; 220/757, 759, 762, 764
See application file for complete search history.

(56) References Cited

U.S. PATENT DOCUMENTS

| | | | | |
|---|---|---|---|---|
| 2,711,944 | A * | 6/1955 | Meek et al. | 312/333 |
| 5,337,910 | A * | 8/1994 | Picozza et al. | 220/367.1 |
| D446,016 | S * | 8/2001 | Dinan et al. | D3/306 |
| 7,748,232 | B2 * | 7/2010 | Kang | 62/371 |
| 7,883,163 | B2 * | 2/2011 | Dorner et al. | 312/404 |
| 7,997,668 | B2 * | 8/2011 | Lee | 312/402 |
| 2006/0130514 | A1 * | 6/2006 | Kim | 62/446 |
| 2006/0266070 | A1 * | 11/2006 | Ertz et al. | 62/441 |
| 2007/0085457 | A1 * | 4/2007 | Park et al. | 312/402 |
| 2010/0001624 | A1 * | 1/2010 | Placke et al. | 312/405 |
| 2010/0090574 | A1 * | 4/2010 | Lim et al. | 312/404 |

* cited by examiner

*Primary Examiner* — Matthew Ing
(74) *Attorney, Agent, or Firm* — McKenna Long & Aldridge LLP

(57) ABSTRACT

A refrigerator is provided with an easily removable basket at an inside of a pull-out door. The refrigerator includes a pull-out door for opening or closing a storage chamber of the refrigerator, rail assemblies mounted in the storage chamber, a frame coupled to the pull-out door and mounted to the rail assemblies to be pulled out from the storage chamber while supported by the rail assemblies, and at least one basket seated on the frame, the basket including at least one handle to take the basket out from the frame.

14 Claims, 5 Drawing Sheets

REFRIGERATOR

Pursuant to 35 U.S.C. §119(a), this application claims the benefit of Korean Patent Application No. 10-2012-0121644, filed on Oct. 30, 2012, which is hereby incorporated by reference as if fully set forth herein.

BACKGROUND

1. Field of the Disclosure

The present disclosure relates to a refrigerator, and, more particularly, to a refrigerator provided with an easily ejectable basket at an inside of a pull-out door.

2. Discussion of the Related Art

Generally, a refrigerator is an appliance for storing food, and etc., within a storage chamber in a frozen or refrigerated state by discharging, into the storage chamber, cold air generated through a refrigeration cycle constituted by a compressor, a condenser, an expansion valve, an evaporator, and etc.

Such a refrigerator generally includes a freezing compartment for storing food or beverages in a frozen state, and a refrigerating compartment for storing food or beverages at low temperature. A Kimchi refrigerator, for instance, which stores food such as Kimchi or vegetables in a fresh state, is another form of refrigerator.

At least one of plural doors installed at a refrigerator is connected to one side of a body, to open or close a front side of the body through pivotal movement thereof. In addition to such a door, which pivots about a hinge, a drawer type door may also be employed in the refrigerator. The drawer type door includes a drawer, and a door mounted to a front side of the drawer, to be pulled out or retracted in a forward or rearward direction, together with the drawer.

For instance, in the case of a large-size bottom freezer type refrigerator, in which a freezing compartment is arranged beneath a refrigerating compartment, a drawer type door is generally employed as a freezing compartment door.

Rail assemblies are mounted to an inside of the freezing compartment door. A basket frame is also coupled to the inside of the freezing compartment door. The basket frame is also coupled to the rail assemblies. A basket for receiving articles to be stored is thus mounted to the basket frame.

The basket stores food therein in a state where it is coupled to the basket frame. When one desires to stow food in the basket or to retrieve food from the basket, stowage or retrieval of food may be possible by opening the drawer type door.

As refrigerators tend to increase in size in recent times, such a refrigerator mainly employs a single basket having a large size, and such a basket is fixed to a basket frame. In this case, however, considerable time is required in retrieving a desired article from the basket when a number of articles are stored in the basket. In addition, considerable time is taken in arranging the articles stored in the basket.

For this reason, considerable loss of cold air is generated during stowage or retrieval of articles as the drawer type door stays open longer.

The basket provided in the freezing compartment is disposed at a lower portion of the refrigerator. For this reason, there may be inconvenience in that the user must stow or retrieve articles by bending over.

Generally, the rail assemblies are mounted to opposite side walls of the freezing compartment at a level equal to or higher than an intermediate portion of the drawer type door.

Since the basket is coupled to the basket frame between a pair of rail assemblies, there may be a problem in that a dead space, in which storage of articles is not possible, is formed beneath the rail assemblies.

SUMMARY

Accordingly, the present disclosure is directed to a refrigerator that substantially obviates one or more problems due to limitations and disadvantages of the related art.

One object is to provide a refrigerator provided with a basket that can be easily taken out from an inside of a pull-out door.

Additional advantages, objects, and features will be set forth in part in the description which follows and in part will become apparent to those having ordinary skill in the art upon examination of the following or may be learned from practice of the invention. The objectives and other advantages may be realized and attained by the structure particularly pointed out in the written description and claims hereof as well as the appended drawings.

To achieve these objects and other advantages and in accordance with the purpose of the invention, as embodied and broadly described herein, a refrigerator includes a pull-out door for opening or closing a storage chamber of the refrigerator, rail assemblies mounted in the storage chamber, a frame coupled to the pull-out door and mounted to the rail assemblies to be pulled out from the storage chamber while supported by the rail assemblies, and at least one removable basket seated on the frame, the basket comprising at least one handle to take the basket out from the frame.

The frame may include a seat formed with a bottom surface, on which the basket is seated.

The frame may further include side walls shaped to enclose lower portions of side walls of the basket.

The basket may be formed to be inclined at at least a lower portion of a side wall of the basket opposing the door.

The handle may include a pair of handles pivotably mounted at a top rim of the basket, to enable a user to lift the basket with one hand.

The rail assemblies may be mounted at lower portions of opposite side walls of the storage chamber, respectively.

The basket may have a greater lateral width at an upper portion thereof than at a lower portion thereof.

The basket may be laterally symmetrical.

The at least one basket may include a pair of baskets having the same shape.

The basket may be formed, at upper portions of side walls thereof, with a plurality of air holes, through which cold air passes.

The refrigerator may further include a drawer mounted over the basket which can be pulled out.

The drawer may include a pair of rollers respectively mounted at a lower surface of a front portion of the drawer at opposite sides of the drawer. The rollers may be supported by a top surface of the basket when the drawer is pulled out.

The drawer may include a pair of rollers respectively mounted at a lower surface of a front portion of the drawer at opposite sides of the drawer. The at least one handle may include a pair of handles pivotably mounted at a top surface of the basket. The rollers may be supported by the handles of the basket when the drawer is pulled out.

In another aspect, a refrigerator includes a pivotable door provided at one side of a body of the refrigerator, to open or close an upper storage chamber defined in the body of the refrigerator, a drawer type door for opening or closing a lower storage chamber defined in the body of the refrigerator, rail assemblies mounted at a level corresponding to ⅓ or less of an inner height of the lower storage chamber, a support base coupled to the rail assemblies at one side of each rail assembly, to be supported by the rail assemblies in a manner in which the support base can be pulled out of the lower storage chamber, and a portable food container separably installed on the support base, wherein upper and side portions of the support base provide a take-out space allowing take-out of the food container in an open state of the drawer type door.

The handle may include a pair of handles pivotably mounted at a top rim of the basket.

The basket may be formed, at upper portions of side walls thereof, with a plurality of air holes, through which cold air passes.

The support base may include a seat having a concave shape to receive a lower portion of the food container in a seated state.

The food container may have a greater width at an upper portion thereof than at a lower portion thereof.

The food container may include a pair of baskets having the same shape, each of the baskets being laterally symmetrical. The support base may include a separation wall formed at a central portion of the support base.

The support base may be fixedly coupled to an inside of the drawer type door. The rail assemblies may be coupled to opposite sides of the support base, respectively.

It is to be understood that both the foregoing general description and the following detailed description are exemplary and explanatory and are intended to provide further explanation of the embodiments of the invention.

BRIEF DESCRIPTION OF THE DRAWINGS

The accompanying drawings, which are included to provide a further understanding of the disclosure and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
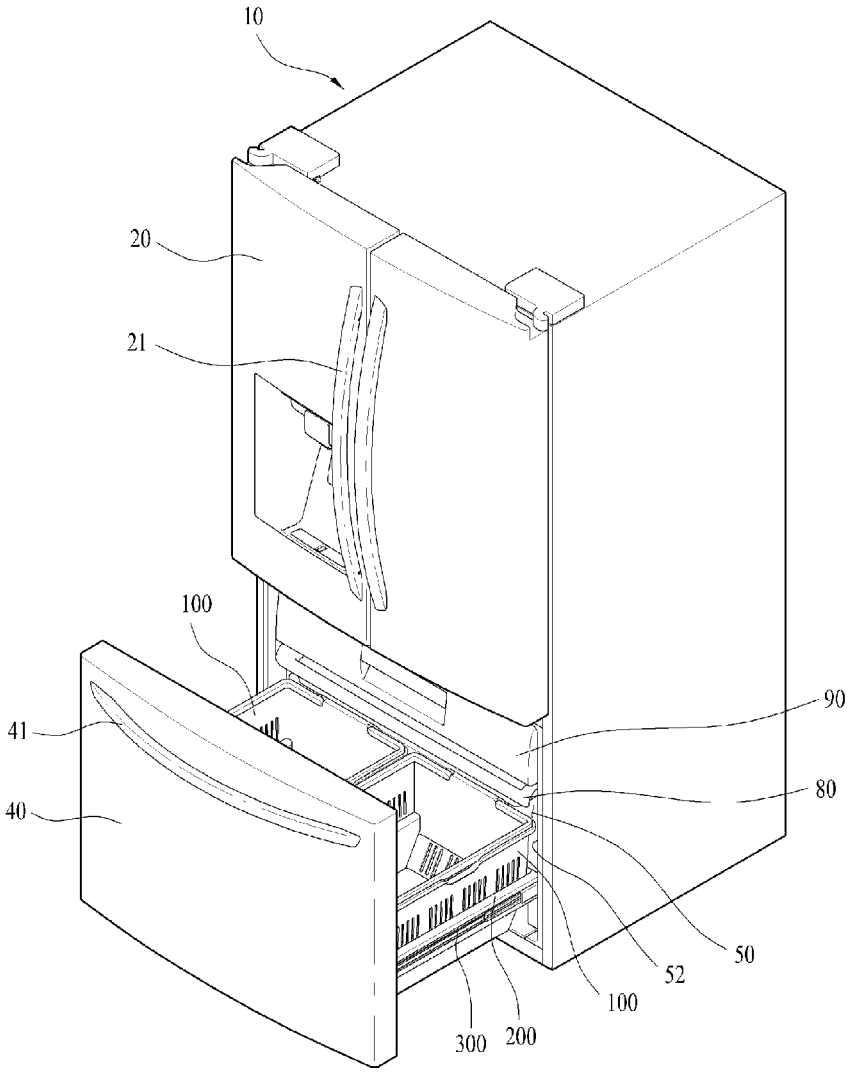
FIG. 1 is a perspective view illustrating a refrigerator according to an exemplary embodiment of the present invention.
Figure 2:
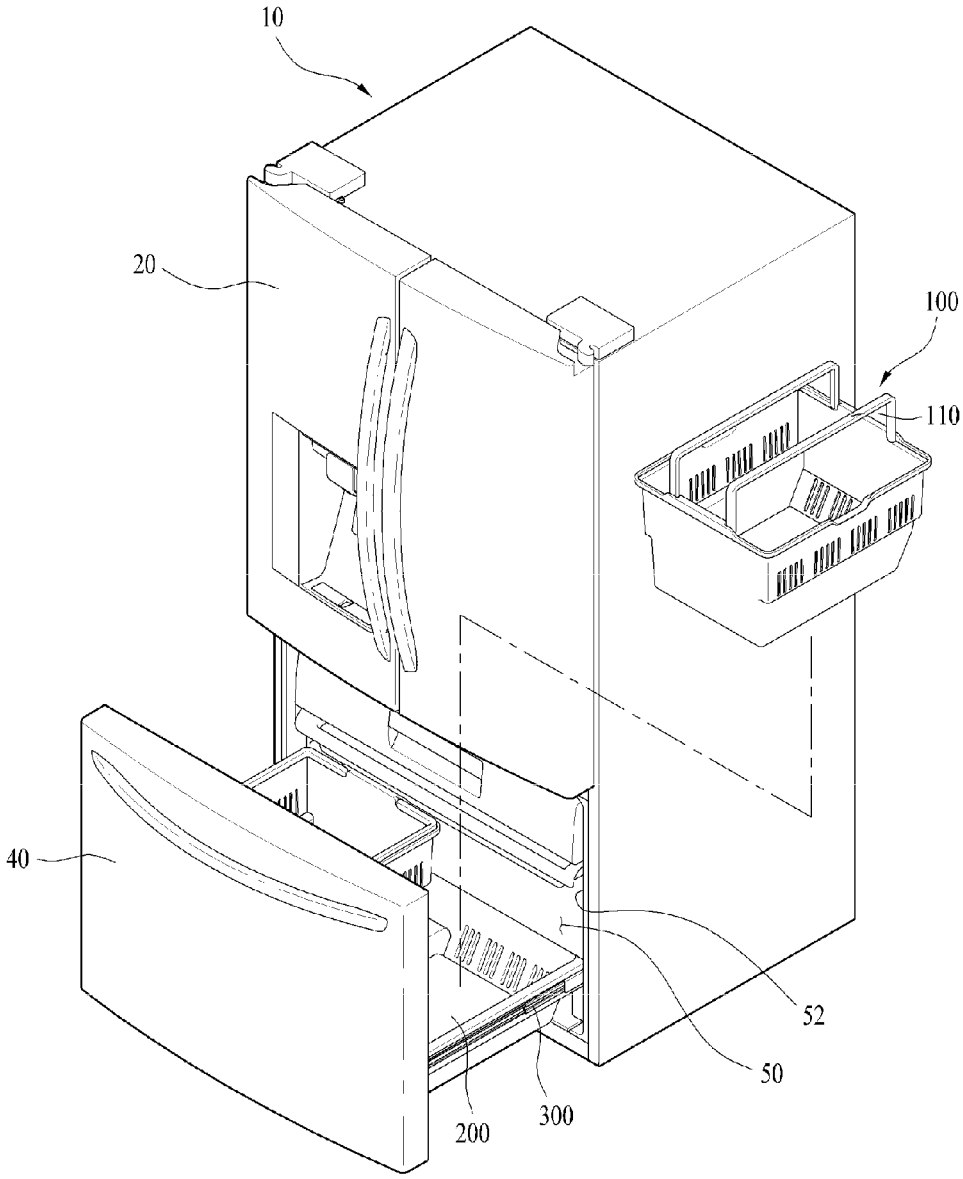
FIG. 2 is a perspective view illustrating a state in which one basket is ejected from the refrigerator of FIG. 1.

FIG. 1 is a perspective view illustrating a refrigerator according to an exemplary embodiment of the present invention. FIG. 2 is a perspective view illustrating a state in which one basket 100 is ejected from the refrigerator of FIG. 1.

The illustrated refrigerator may be a bottom freezer type refrigerator in which a refrigerating compartment is provided at an upper portion of a body 10 defined with a storage space therein, and a freezing compartment 50 is provided at a lower portion of the body 10.

However, the present invention is not limited to such a bottom freezer type refrigerator. The present invention may be applied to refrigerators of other types, so long as a basket is mounted to a pull-out door.

As illustrated in FIG. 1, a refrigerating compartment is arranged at the upper portion of the body 10, and a pair of refrigerating compartment doors 20 to open or close an opened front side of the refrigerating compartment is pivotably mounted to opposite lateral sides of the body 10 by hinges.

Door handles 21 are provided at respective refrigerating compartment doors 20.

A freezing compartment 50 is arranged at the lower portion of the body 10. An opened front side of the freezing compartment 50 is opened or closed by a freezing compartment door 40, which is a pull-out door.

The freezing compartment door 40 is a pull-out door, namely, a drawer type door installed to be pulled out or retractable in a forward or rearward direction with respect to the freezing compartment 50 like a drawer.

A door handle 41 is provided at the freezing compartment door 40. Generally, the door handle 41 extends laterally when the freezing compartment door 40 is a pull-out door installed at the lower portion of the body 10.

A frame 200 is coupled to an inner surface of the freezing compartment door 40, to support a basket 100, which forms at least a portion of the storage space defined in the freezing compartment.

Rail assemblies 300 are coupled between an outer surface of the frame 200 and an inner surface of the freezing compartment 50.

The rail assemblies 300 support the frame 200, the freezing compartment door 40 coupled to the frame 200, and the basket 100 seated on the frame 200, and enables these elements to be smoothly pulled in and out with respect to the freezing compartment 50.

In illustrated embodiment, only the above-described basket 100 may be provided in the freezing compartment 50, as a container to store articles. Preferably, other storage means such as a rack or a drawer are disposed on the basket 100.

In the illustrated embodiment, a drawer 80 is disposed on the basket 100, and a drawer 90 is disposed on the drawer 80.

Figure 5:
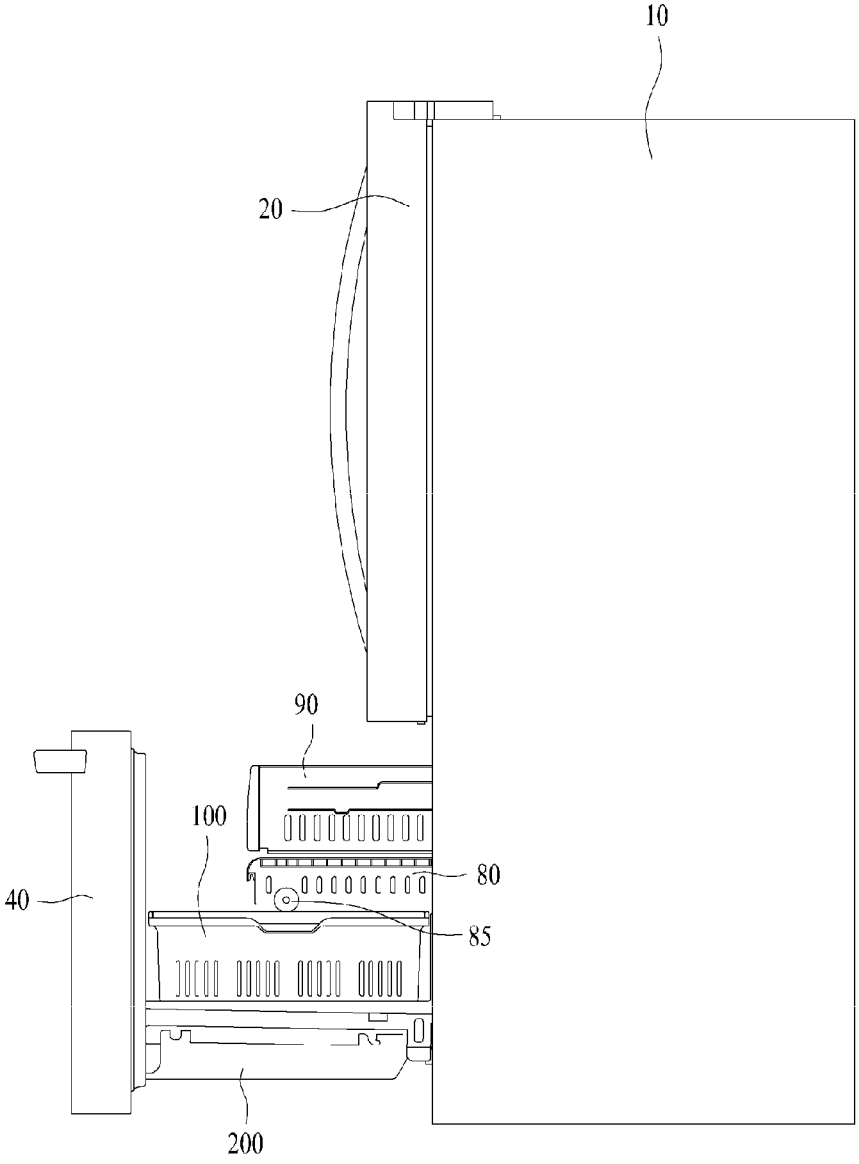
FIG. 5 is a side view illustrating pull-out of a drawer disposed over baskets in a pulled-out state of the freezing compartment door in the refrigerator according to the illustrated embodiment of the present invention.

The drawers 80 and 90 are slidably mounted by guides or rails provided at opposite lateral surfaces of the freezing compartment 50 (FIG. 5).

In the refrigerator according to the illustrated embodiment of the present invention, the basket 100 is not coupled to the frame 200, but is removably seated on the frame 200, as illustrated in FIG. 2, to be easily separated from the frame 200, and take-out thereof.

Figure 4:
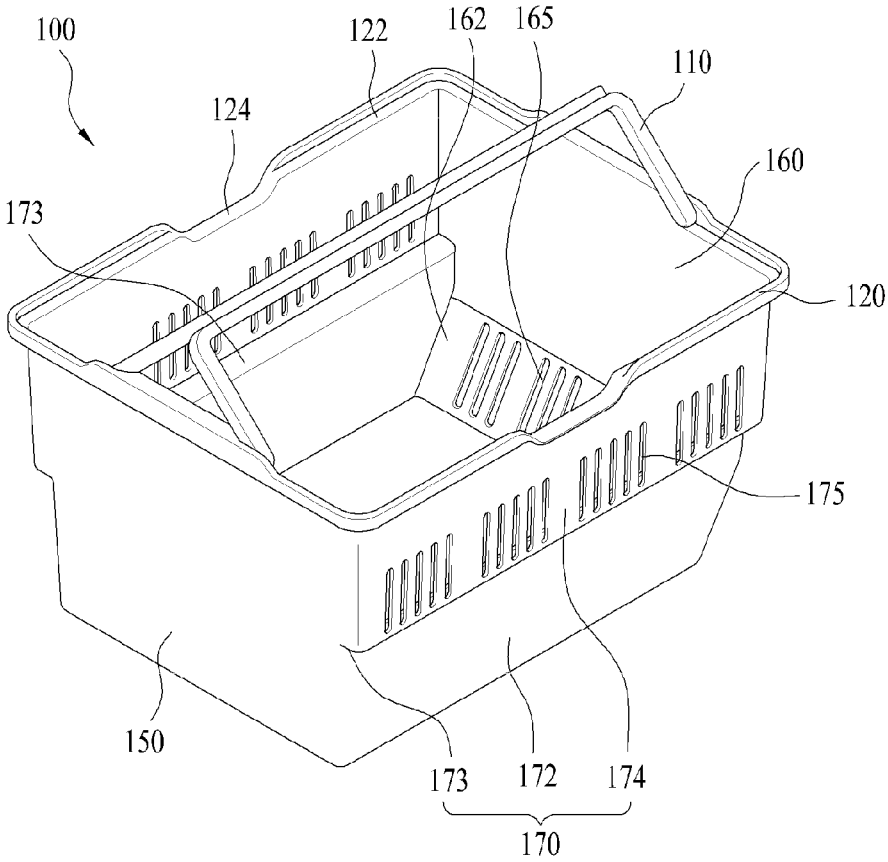
FIG. 4 is a perspective view illustrating a basket employed in the refrigerator according to the illustrated embodiment of the present invention.

The basket 100 may include a pair of handles 110 pivotably mounted to a top rim of the basket 100, to enable the user to lift the basket 100 with one hand (FIG. 4).

In conventional cases, a basket is installed in such a manner that a top rim of the basket is coupled to a pair of bar-shaped frames perpendicularly coupled to an inner surface of a door at opposite sides of the door.

On the other hand, in the illustrated embodiment, the frame 200 includes a bottom, on which a bottom of the basket 100 is seated. Accordingly, the basket 100 is simply seated on the bottom of the frame 200 and removable, as such, the user may easily take the basket 100 out of the frame 200.

Meanwhile, refrigerators are tending to increase in size in recent times. When a single basket having a width approximating the inner width of a freezing compartment in such a large-size refrigerator is installed in the freezing compartment, stowage or retrieval of articles, in particular, small-size articles, into or from the basket may be inefficient. Further, taking the basket, which has a large size and a great capacity, in particular, when many number of articles are contained in the basket, out of the refrigerator may not be possible due to heavy weight thereof. Also, searching for the articles in the basket will cause the freezing compartment to be opened for a long time, and thereby increased loss of cold air may be generated.

To this end, in the illustrated embodiment of the present invention, two baskets 100 having a width corresponding to half the lateral width of the freezing compartment 50 are preferably provided to be seated on the frame 200.

The two baskets 100 have the same shape and, as such, there may be convenience of use in that the baskets 100 may be interchangeably seated on the frame 200.

Figure 3:
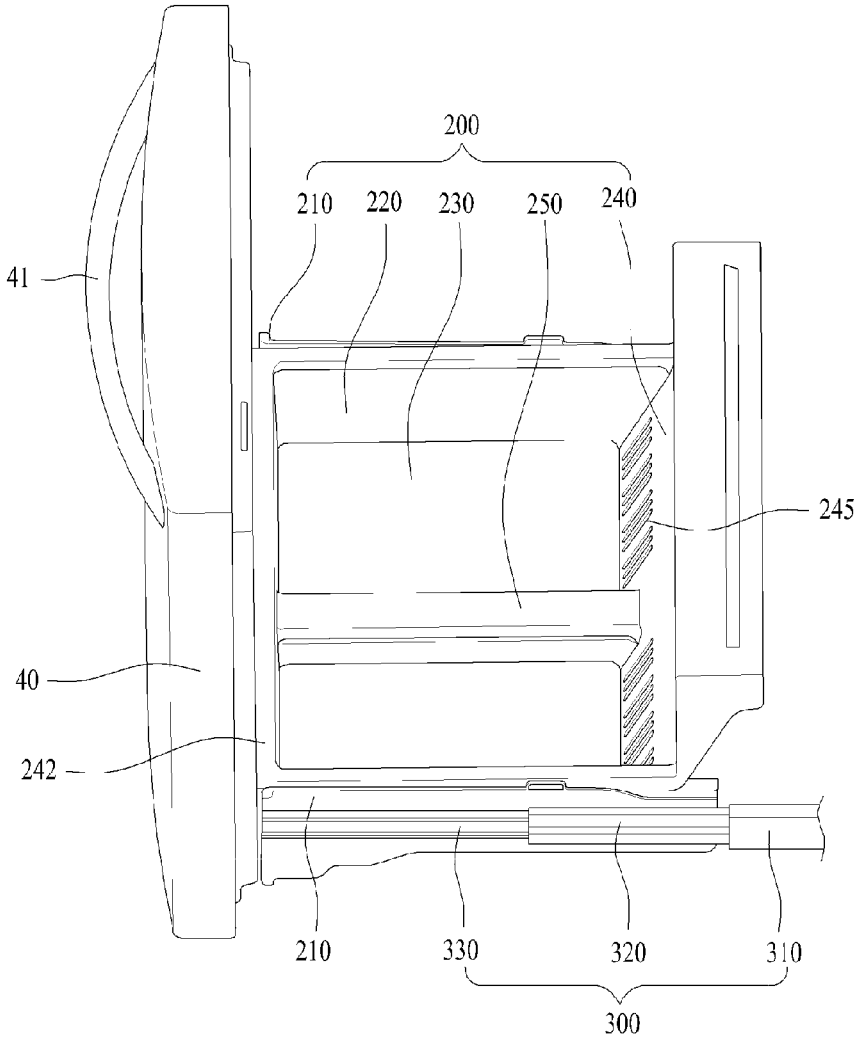
FIG. 3 is a perspective view illustrating a freezing compartment door, a frame coupled to the freezing compartment door, and a rail assembly coupled to the frame according to the illustrated embodiment of the present invention.

FIG. 3 is a perspective view illustrating a freezing compartment door, a frame coupled to the freezing compartment door, and a rail assembly coupled to the frame according to the illustrated embodiment of the present invention.

The frame 200 supports the baskets 100 under the condition that the baskets 100 are removably seated on the frame 200. In this regard, the frame 200 may be a "support base" to support the baskets 100.

The frame 200 includes side frames 210 fixedly coupled to the freezing compartment door 40.

Side walls 220 of the frame 200 are supported by the side frames 210, respectively.

A rear wall 240 is provided between rear ends of the side walls 220. The rear wall 240 may have a greater height than the side walls 220.

The rear wall 240 may have an upper surface disposed at a level approximating a level of a bottom of the drawer 80 (FIG. 5).

Meanwhile, a machinery chamber may be provided in a region defined in a rear of the freezing compartment 50 at a lower portion of the refrigerator. To form the machinery chamber, a lower portion of a rear wall of the freezing compartment 50 may be inclined.

In this case, accordingly, the rear wall 240 may be inclined to correspond to the inclination of the lower portion of the rear wall of the freezing compartment 50.

A front wall 242 may be formed between front ends of the side walls 220 while having the same height as the side walls 220.

The bottom of the frame 200 enclosed by the walls of the frame 200 is closed by a bottom wall 230. Accordingly, the bottom of each basket 100 is supported by the bottom wall 230 in a seated state.

In order to prevent the two baskets 100 from moving laterally, a separation wall 250 extends upwardly from a central portion of the bottom wall 230.

Thus, the baskets 100 are supported not only by the bottom wall 230, but also by the front, rear, and side walls 242, 240, and 220 of the frame 200 and, as such, may be prevented from moving during opening or closing of the freezing compartment door 40.

Meanwhile, a plurality of air holes 245 is formed through the rear wall 240 at a lower portion of the rear wall 240, to achieve efficient supply of cold air to the basket 100.

The baskets 100 may be formed with air holes 165 (FIG. 4) corresponding to the air holes 245, to achieve more efficient supply of cold air, as will be described later.

The rail assemblies 300 are coupled to opposite sides of the frame 200, respectively.

In detail, each rail assembly 300 includes a fixed rail 310 coupled to an inner side wall 52 of the storage chamber (FIG. 1), namely, one inner side wall 52 of the freezing compartment 50, an intermediate rail 320 supported by the fixed rail 310, and a movable rail 330 slidably coupled to the intermediate rail 320.

Of course, the rail assembly 300 may be constituted by a double rail structure including a fixed rail and a movable rail slidably inserted into the fixed rail. However, the above-described triple rail structure, which additionally includes the intermediate rail, is preferable in that an extension length increases.

Preferably, the rail assemblies 300 are mounted toward the bottom of the freezing compartment 50 at opposite sides of the freezing compartment 50, respectively.

When the rail assemblies 300 are mounted to opposite side walls of the freezing compartment 50 at a level equal to or higher than an intermediate portion of the freezing compartment 50, as in the conventional case, a dead space, in which storage of articles is not possible, is formed beneath the rail assemblies 300.

In the above scenario, the baskets 100 may be seated or mounted on the frame 200 supported by the rail assemblies 300. However, it may be difficult to mount the baskets 100 on the frame 200 when each basket 100 has a greater bottom width than a top width in order to enable utilization of a space defined beneath the rail assemblies 300.

In the illustrated embodiment, the rail assemblies 300 are mounted toward the bottom of the freezing compartment 50 at opposite sides of the freezing compartment 50, respectively. Accordingly, it may be possible to utilize the space defined over the rail assemblies 300 as a storage space.

In particular, the rail assemblies 300 are mounted at a level corresponding to ⅓ or less of the inner height of the freezing compartment 50, in order to support the frame 200 and freezing compartment door 40 such that the frame 200 and freezing compartment door 40 may be pulled out.

To enable utilization of a space defined over the rail assemblies 300, the baskets 100 have a particular shape, which will be described later.

Hereinafter, a preferred shape of each basket 100 will be described in detail with reference to FIG. 4.

The basket 100, which is a container for containing food, may be referred to as a "portable food container" in that the user may take the basket 100 out of the refrigerator by simply lifting the basket 100 after opening the freezing compartment door 40, and may carry the basket 100, for use thereof at other places.

As described above, the basket 100 includes a pair of handles 110 pivotably mounted to the top rim of the basket 100.

When the basket 100 is disposed within the freezing compartment 50, it may be possible to prevent the handles 110 from interfering with the drawer 80 disposed over the basket 100 because the handles 110 are pivotable to align to seat at the contours of the top rim of the basket 100. In addition, since the handles 110 are pivotable, the user may lift the basket 100 after moving the handles 110 toward each other and then grasping the handles 110 by one hand.

The top rim 120 of the basket 100 has an outwardly protruded shape.

Pivot pins are provided at desired positions on the rim 120, to pivotably mount the handles 110. Taking into consideration pivotal movement of the handles 110, support steps 122 are provided at an inside of the rim 120, in order to allow the handles 110 to be seated on the support steps 122.

Grooves 124 may be centrally formed at side portions of the rim 120, to enable the user to easily lift the handles 110 with one hand in a state in which the handles 110 are seated on the support steps 122.

Preferably, opposite side walls 170 of the basket 100 have a stepped wall structure having a step, in place of a flat wall structure. That is, each side wall 170 of the basket 100 includes a first side wall portion 172 formed at a lower portion of the side wall 170, and a second side wall portion 174 formed at an upper portion of the side wall 170 while having a greater width than the first side wall portion 172. The first and second side wall portions 172 and 174 are connected by a step 173.

The rail assemblies 300 are mounted at a level corresponding to the level of the first side wall portions 172. Accordingly, the width between the opposite second side wall portions 174 of each basket 100 is preferably greater than the width between the first side wall portions 172, for utilization of the space defined over the rail assemblies 300.

That is, each basket 100 preferably has a greater upper width than a lower width.

Each basket 100 includes a front wall 150, which is a vertical flat surface, which in the illustrated embodiment, is spaced apart from the inner surface of the door 40 by a certain distance in a state in which the basket 100 is seated on the frame 200.

Each basket 100 also includes a rear wall 160 opposing the front wall 150. The rear wall 160 has an upper portion having a vertical flat wall surface, and a lower portion having an inclined surface 162.

The inclined surface 162 conforms to an inclined inner surface of the rear wall 240 of the frame 100 and, as such, contacts the inclined inner surface, to be supported by the inclined inner surface.

Each basket 100 preferably has a laterally symmetrical structure.

As described above, the refrigerator is preferably provided with two baskets, in place of a single large basket having a great width. Accordingly, it may be possible to efficiently store food while achieving convenience of use.

The two baskets 100 preferably have the same shape.

Since the two baskets 100 have the same shape while being laterally symmetrical, it may be possible to seat the baskets 100 on a concave seat of the frame 200 interchangeably.

Of course, each basket 100 should be seated on the frame 200 under the condition that the front and rear sides of the basket 100 meet forward and rearward mounting directions of the frame 200, respectively. When the front and rear sides of the basket 100 do not correspond to the forward and rearward mounting directions of the frame 200, the basket 100 cannot be seated on the frame 200. Accordingly, when the basket 100 cannot be seated on the frame 200 due to discordance of the front and rear sides of the basket 100 to the forward and rearward mounting directions, seating of the basket 100 may be achieved by reversing the basket 100.

The basket 100 may be formed, at the upper portions of the side walls thereof, with a plurality of air holes, through which cold air passes.

The installation level of the rail assemblies 300 coupled to the outer surface of the frame corresponds to the height of the first side wall portions 172 of the basket 100.

Since the second side wall portions 174 are seated at a higher level than the side walls of the frame 200, there is no obstacle between each side wall portion 174 and the inner wall surface of the freezing compartment 50 (FIG. 1).

A plurality of air holes 175 is formed through the second side wall portions 174, to efficiently supply cold air in the freezing compartment 50 to the interior of the basket 100.

The basket 100 can be easily removed from the frame 200 because the handles 110 are provided at the basket 100. In accordance with formation of the plural air holes 165 and 175, it may be possible to efficiently supply cold air in the freezing compartment 50 to the basket 100.

The plural air holes 165, which are provided at the rear wall of the basket 100, may have an arrangement corresponding to that of the plural air holes 245 (FIG. 3).

When the freezing compartment door 40, which is a drawer type door, is opened, the upper and side portions of the frame 200, which functions as a support base for the baskets 100, provide a take-out space allowing take-out of the basket 100 without interference.

That is, since the top and side surfaces of each basket 100 are outwardly exposed in a state in which the freezing compartment door 40 is completely pulled out, the user may easily remove the basket 100 from the freezing compartment 50 by lifting the basket 100 while grasping the handles 110.

FIG. 5 is a side view illustrating pull-out of the drawer disposed over the baskets in a pulled out state of the freezing compartment door in the refrigerator according to the illustrated embodiment of the present invention.

As described above, two drawers 80 and 90 may be mounted over the baskets 100. The two drawers 80 and 90 may be independently pulled out.

One or more pairs of rollers 85 are supported by roller guides (not shown) formed at opposite side walls of the freezing compartment 50 and, as such, the drawer 80, which is an intermediate drawer, may be slidably mounted.

In particular, the roller pairs, which are provided at opposite sides of a bottom of the intermediate drawer 80, may include a pair of rollers (not shown) disposed at a rear portion of the intermediate drawer 80, and a pair of rollers 85 disposed at a front portion of the intermediate drawer 80.

Thus, the front rollers 85 may be supported by the upper surfaces of the rims 120 of the baskets 100 or by the handles 110 of the baskets 100 when the intermediate drawer 80 is pulled out.

To this end, the positions of the rims 120 of the baskets 100 or handles 110 contacting the rollers 85 should correspond to left and right positions of the rollers 85, respectively.

In addition, the rims 120 of the baskets 100 or handles 110 may have a shape capable of stably supporting the rollers 85. For example, the rims 120 or handles 110 may have an increased width.

Stoppers such as lugs may be formed at the upper surfaces of the rims 120 of the baskets 100 or handles 110, to limit a rolling movement range of the rollers 85.

The drawer 90, which is an upper drawer, may be supported by separate rail assemblies mounted to opposite side walls of the freezing compartment 50.

The intermediate drawer 80 has a small height, whereas the upper drawer 90 has a greater height than the intermediate drawer 80.

In this case, the amount of food stored in the upper drawer 90 may be larger than that of the intermediate drawer 80, and the weight of food stored in the upper drawer 90 may be heavier than that of the intermediate drawer 80. Nevertheless, the upper drawer 90 may be smoothly pulled out while exhibiting excellent durability because the upper drawer 90 is supported by separate rail assemblies as described above.

In accordance with such a configuration, it is unnecessary to support the upper drawer 90 by the intermediate drawer 80. The upper drawer 90 may also be independently pulled out, irrespective of the intermediate drawer 80.

In accordance with the embodiments of the present invention, it may be possible to easily remove the baskets mounted at an inside of the pull-out door, and to conveniently use the removed basket. In addition, the storage space may be efficiently utilized. It may be possible to achieve efficient supply of cold air in the storage chamber by provision of plural air holes.

Since the baskets mounted at an inside of the pull-out door can be easily removed, it is unnecessary to open the door for a long time and, as such, loss of cold air may be minimized.

In accordance with appropriate arrangement of the frame and rail assemblies and an improved shape of the baskets, the storage space of the storage chamber may be efficiently utilized.

Since a plurality of air holes is formed through the baskets, it may be possible to efficiently supply in the storage chamber to the baskets.

It will be apparent to those skilled in the art that various modifications and variations can be made without departing from the spirit or scope of the invention. Thus, it is intended that the claims covers the modifications and variations.

What is claimed is:

1. A refrigerator comprising:

a cabinet having an upper storage chamber and a lower storage chamber;

a pull-out door to open or close the lower storage chamber;

a pair of rail assemblies mounted in the lower storage chamber at lower portions of side walls of the lower storage chamber;

a frame coupled to a lower portion of the pull-out door and mounted to the rail assemblies to be pulled out from the lower storage chamber while supported by the rail assemblies, the frame comprising a bottom wall and a separation wall protruded from the bottom wall;

a pair of baskets removably seated on the bottom wall of the frame; and a pair of handles pivotably mounted at a top rim of the basket, to enable a user to lift and take out the basket with one hand, a support portion being provided at the top rim of the basket; and a plurality of air holes formed in the side walls of the basket through which cold air passes, wherein an access space is provided over the rail assembly so that the basket may be taken out from the bottom wall of the frame laterally when the pull-out door is opened.

2. The refrigerator according to claim 1, wherein the frame further comprises side walls shaped to enclose lower portions of side walls of the basket.

3. The refrigerator according to claim 2, wherein the basket is formed to be inclined at at least a lower portion of a side wall of the basket opposing the door.

4. The refrigerator according to claim 1, wherein the basket has a greater lateral width at an upper portion thereof than at a lower portion thereof.

5. The refrigerator according to claim 4, wherein the basket is laterally symmetrical.

6. The refrigerator according to claim 5, wherein the pair of baskets have the same shape.

7. The refrigerator according to claim 1, further comprising:

a drawer mounted over the pair of baskets which can be pulled out.

8. The refrigerator according to claim 7, wherein:

the drawer comprises a pair of rollers respectively mounted at a lower surface of a front portion of the drawer at opposite sides of the drawer; and the rollers are supported by a top surface of the basket when the drawer is pulled out.

9. The refrigerator according to claim 7, wherein:

the drawer comprises a pair of rollers respectively mounted at a lower surface of a front portion of the drawer at opposite sides of the drawer; and the rollers are supported by the handles of the basket when the drawer is pulled out.

10. A refrigerator comprising:

a pivotable door provided at one side of a body of the refrigerator, to open or close an upper storage chamber defined in the body of the refrigerator;

a drawer type door to open or close a lower storage chamber defined in the body of the refrigerator;

a pair of rail assemblies mounted at a level corresponding to ⅓ or less of an inner height of the lower storage chamber;

a support base coupled to the pair of rail assemblies at one side of each rail assembly, to be supported by the rail assemblies in a manner in which the support base can be pulled out of the lower storage chamber, the support base, a bottom wall and a separation wall formed at a central portion of the support base;

a pair of portable food containers separably installed on the bottom wall of support base;

a pair of handles pivotably mounted at a top rim of the food container, to enable a user to lift and take out the food container with one hand; and a plurality of air holes formed at upper portions of the side walls of the food container through which cold air passes, wherein upper and side portions of the support base provide a take-out space allowing take-out of the food container in an open state of the drawer type door.

11. The refrigerator according to claim 10, wherein the support base comprises a seat having a concave shape to receive a lower portion of the food container in a seated state.

12. The refrigerator according to claim 11, wherein the food container has a greater width at an upper portion thereof than at a lower portion thereof.

13. The refrigerator according to claim 12, wherein the pair of food containers have the same shape, each of the food containers being laterally symmetrical.

14. The refrigerator according to claim 11, wherein:

the support base is fixedly coupled to an inside of the drawer type door; and the pair of rail assemblies are coupled to opposite sides of the support base, respectively.

* * * * *